US007254904B2

(12) United States Patent
Nye

(10) Patent No.: US 7,254,904 B2
(45) **Date of Patent: *Aug. 14, 2007**

(54) TOE SHOE

(76) Inventor: William S. Nye, 200 First Ave. West, Suite 400, Seattle, WA (US) 98119

( * ) Notice: Subject to any disclaimer, the term of this patent is extended or adjusted under 35 U.S.C. 154(b) by 0 days.

This patent is subject to a terminal disclaimer.

(21) Appl. No.: 11/125,680

(22) Filed: May 10, 2005

(65) Prior Publication Data

US 2005/0198861 A1 Sep. 15, 2005

Related U.S. Application Data

(62) Division of application No. 10/299,554, filed on Nov. 19, 2002, now Pat. No. 6,895,694.

(51) Int. Cl.
*A43B 5/12* (2006.01)

(52) U.S. Cl. ..... 36/8.3

(58) Field of Classification Search ..... 36/8.3, 36/96

See application file for complete search history.

(56) References Cited

U.S. PATENT DOCUMENTS

RE17,753 E * 7/1930 Haney ..... 36/8.3
2,810,214 A * 10/1957 Wolfe ..... 36/8.3
3,797,137 A * 3/1974 Harkness ..... 36/113
4,026,046 A * 5/1977 Clark et al. ..... 36/113
4,901,453 A * 2/1990 Gaynor ..... 36/113
6,895,694 B2 * 5/2005 Nye ..... 36/8.3

FOREIGN PATENT DOCUMENTS

DE 241010 A * 11/1986

* cited by examiner

*Primary Examiner*—Ted Kavanaugh
(74) *Attorney, Agent, or Firm*—Miller Nash LLP

(57) ABSTRACT

A toe shoe capable of providing support to a ballet dancer's foot while dancing en pointe. The toe shoe preferably includes a toe box in the toe of the toe shoe, an upper, and an outer sole. Support structure within the toe shoe includes a longitudinal support member, a foot encirculating tubular sleeve, and/or a toe ridge. In a first preferred embodiment, the support structure includes the longitudinal support member, foot encirculating tubular sleeve, and toe ridge. In a second preferred embodiment, the support structure includes the longitudinal support member and foot encirculating tubular sleeve. In a third preferred embodiment, the support structure is the longitudinal support member and toe ridge.

1 Claim, 4 Drawing Sheets

TOE SHOE

CROSS-REFERENCE(S) TO RELATED APPLICATION(S)

This is a divisional application claiming the benefit of U.S. patent application Ser. No. 10/299,554 entitled "Toe Shoe" filed Nov. 19, 2002 now U.S. Pat. No. 6,895,694, which is hereby incorporated to this application by this reference.

BACKGROUND OF INVENTION

A. Field of Invention

The present invention is directed to a toe shoe, and more specifically, to a toe shoe capable of providing support to a ballet dancer's foot, toes, and ankle during en pointe dancing.

B. Description of the Related Art

The design and materials of the traditional toe shoe, also known as a "pointe shoe," have remained virtually unchanged for centuries. Generally made by hand, the traditional toe shoe utilizes layers of fabric, burlap, cardboard, paper, plastic, leather, or any combination thereof. The layers of material may be saturated with glue to form a reinforced toe box. A hard insole, called a "shank," and an outer sole are attached to the toe box. Glue, stitching, small nails, or any combinations thereof, hold the toe shoe together. A fabric upper, usually a pink satin material, covers the toe shoe. Satin ribbons or elastic straps are often sewn to the sides of the toe shoe and tied or secured around the ballet dancer's ankle to ensure that the toe shoe remains on the dancer's foot.

Although the traditional toe shoe has been used by many generations of ballet dancers, the traditional toe shoe is known in the art to be uncomfortable, even painful. The toe box compresses the sides of the foot, often exacerbating problems that are associated with the hopping and leaping en pointe required by ballet choreography. Further, traditional toe shoes lack shock absorption, offering no protection to the ballet dancer who must repeatedly jump during the course of a performance or practice.

General principles of physics illustrate how dancing en pointe, when performed in traditional toe shoes, creates forces that act on the body of the ballet dancer. It is believed that these forces contribute to the daily wear and tear on a dancer's body, and specifically, to the dancer's toes, feet, and ankles.

For example, ballet dancing involves movements of the dancer's body interspersed with motionless poses. When a ballet dancer dancing en pointe is positioned in a motionless pose, the sum of all forces and torques acting on the dancer's body is approximately zero. This means that the dancer's center of gravity lies on a vertical line that passes from the dancer's body down to the area of support, which is the dancer's foot, toes, and ankle. This downwardly directed force of gravity is balanced by a force rising upward from the floor on that same vertical line. Therefore, the dancer's foot, toes, and ankle are subject to a force that is at least equal to the dancer's weight. This force may increase as the dancer accelerates from a flat-footed position to an en pointe position while practicing or performing.

Ballet dancing also involves turns en pointe, which are commonly known in the art as pirouettes on the point of a ballet dancer's toe shoes. Pirouettes specifically require turns on the front end of the toe box of the toe shoe. The pirouette begins with a preparatory position. The dancer then rotates her arms, torso, and legs with respect to the floor. The twisting force or torque of the dancer's body is carried into the floor by her foot, which allows her to produce the turning motion of the pirouette as she goes from the sole of her foot to en pointe. The upward torque from the floor against the dancer causes an angular acceleration that produces the turning motion. The dancer's toes, feet, and ankles absorb the brunt of the floor's torque.

In addition to forces acting on the ballet dancer's toes, foot, and ankle, there is upward tension in a dancer's achilles tendon because the dancer must push her toes down into the floor in order to remain en pointe while dancing. This tension in the achilles tendon increases as a dancer accelerates from a flat-footed position to an en pointe position, which requires the dancer to push her toes down and lift her heel up. As a result, the achilles tendon must withstand a tension force two to three times the dancer's body weight. With a traditional toe shoe, this tension force is carried longitudinally through the dancer's arched foot to her ankle and leg.

The forces acting on ballet dancers' toes, feet, and ankles, along with the construction of traditional toe shoes, contribute to a number of dancing-related injuries. These injuries include, but are not limited to bunions, blisters, corns, crooked toes, potential or actual stress fractures, tendinitis, sprains, metatarsal bruises, bruises, toe dislocations, and early onset of arthritis. While some of these injuries are relatively minor and heal quickly, other injuries can end a ballet dancer's career.

There have been many attempts to improve upon the traditional toe shoe. U.S. Pat. No. 5,191,726 to Vallee (the "Vallee reference"); U.S. Pat. No. 5,740,618 to Minden (the "Minden '618 reference"); U.S. Pat. No. 5,035,069 to Minden (the "Minden '069 reference"); and U.S. Pat. No. 4,901,453 to Gaynor (the "Gaynor reference") are exemplary of these attempts and are described to show the current state of the art.

The Vallee reference sets forth a ballet shoe designed specifically for either the left or right foot. The shoe is composed of a sole, a flexible upper that is fixed to the sole, and a vamp that is adapted to surround the front part of the foot. The upper is designed so that points of maximum height of the shoe are located to one side of a longitudinal plane of the shoe, while a flat widening of the shoe occurs on the other side of the longitudinal plane, thereby creating a shoe that is specifically intended for either the left or right foot of a dancer.

The Minden '618 reference sets forth a dance shoe having a toe box that is integrally formed with a shank. Within the toe box are removable foam pads that may be located in at least one of the left and right side surfaces of the toe box, against both the left and right side surfaces of the toe box, or covering the top surface and the left and right side surfaces of the toe box. The foam pads are composed of a dynamic foam pad with a low-compression set, such that the foam pad is compressed by a dancer's foot when the foot is in the flat standing position and expands when the dancer is standing en pointe.

The Minden '069 reference sets forth a ballet slipper having a shank and toe box molded from a thermoplastic polymeric material. The toe box is composed of a platform exterior surface at the forward end of the toe box, a curved radius exterior surface joining the platform, and the lower surface of the shank. The shoe further discloses a layer of resilient, shock-absorbing polymeric material that covers at least a portion of at least one of the lower surfaces of the shank, the exterior surface of the platform, and the exterior surface of the radius of the toe box.

The Gaynor reference sets forth a ballet slipper having a shank and toe box molded from a thermoplastic polymeric material. When the thermoplastic polymeric material is heated, the material softens, thereby allowing the dancer to adjust the shank and toe box to his or her foot. The toe box includes a platform at its forward end and a curved radius joining the platform and the toe box. The ballet slipper has a polymeric material that lines the interior portion of the toe box and extends backwards from the edges of the toe box. A shock-absorbing polymeric material covers the exterior surface of the curved radius and the platform.

Additionally, there have been several general-footwear companies that have focused on caring for feet by providing footwear and foot bed inserts that conform to the shape of the wearer's foot for the purposes of walking or running. Such general footwear, which include sandals, clogs, ski boots, skates, and shoes, is constructed to match the shape of the wearer's foot. The general footwear and foot bed inserts are designed so that when the wearer is walking upright, the wearer's foot is in as natural a position as it would be if the wearer were walking barefoot.

One example of this type of general footwear is the BIRKENSTOCK® sandal, manufactured by Birkenstock Orthopadie of Germany. In addition to being in the shape of a regular foot, the BIRKENSTOCK® sandal has a natural-shaped footbed that allows room for the foot to maintain a normal position while walking. Additionally, a BIRKENSTOCK® sandal usually implements a raised toe bar. The toe bar encourages the natural gripping motion of the wearer's foot, exercises the legs, and improves circulation while the wearer is walking. The BIRKENSTOCK® sandal further contains an arch support that ensures even weight distribution and proper support of the wearer's foot. Finally, the BIRKENSTOCK® sandal contains a deep heelcup, which keeps the foot's natural padding directly under the heelbone. The toe bar, arch support, and deep heelcup are all provided in order to match the shape of the sandal with the shape of the wearer's foot.

The DR. SCHOLL'S® exercise sandal, manufactured by Scholl, Inc., a Delaware corporation, implements a contoured heel and toe grip. The heel and toe grip are provided to strengthen wearers' legs, feet, and ankles as they walk. The bottom half of the sandal is usually made of wood, and the sandal is manufactured such that wearers must grip the sandals with their toes when walking to ensure that the sandals do not slip off easily.

As a whole, the above-mentioned prior art is incapable of and improper for use in a ballet dance setting; it fails to provide the proper support to ballet dancers' feet, toes, and ankles during en pointe dancing; and it does not retain the aesthetic appearance of a traditional toe shoe.

BRIEF SUMMARY OF THE INVENTION

The present invention is directed to a toe shoe, and more specifically, to a toe shoe capable of providing support to a ballet dancer's foot during en pointe dancing.

All of the embodiments of the toe shoe of the present invention preferably include a toe box in the toe of the toe shoe, an upper, an outer sole, and a support structure. The support structure, preferably located within the toe shoe, may include a longitudinal support member, a foot encirculating tubular sleeve, and/or a toe ridge. In a first preferred embodiment, the support structure is a longitudinal support member, foot encirculating tubular sleeve, and toe ridge. In a second preferred embodiment, the support structure is a longitudinal support member and tubular sleeve. A third preferred embodiment of the present invention is a toe shoe with a support structure including a longitudinal support member and toe ridge.

The foregoing and other objectives, features, and advantages of the invention will be more readily understood upon consideration of the following detailed description of the invention, taken in conjunction with the accompanying drawings.

DETAILED DESCRIPTION OF THE INVENTION

The present invention is directed to a toe shoe, and more specifically, to a toe shoe capable of providing support to a ballet dancer's foot, toes, and ankle during en pointe dancing. The preferred embodiments of the toe shoe of the present invention are designed to divert forces acting directly on a ballet dancer's foot, toes, and ankle. The preferred embodiments of the toe shoe of the present invention are further designed to retain the aesthetic shape and appearance of the traditional toe shoe commonly known and used in the art.

Figure 1:
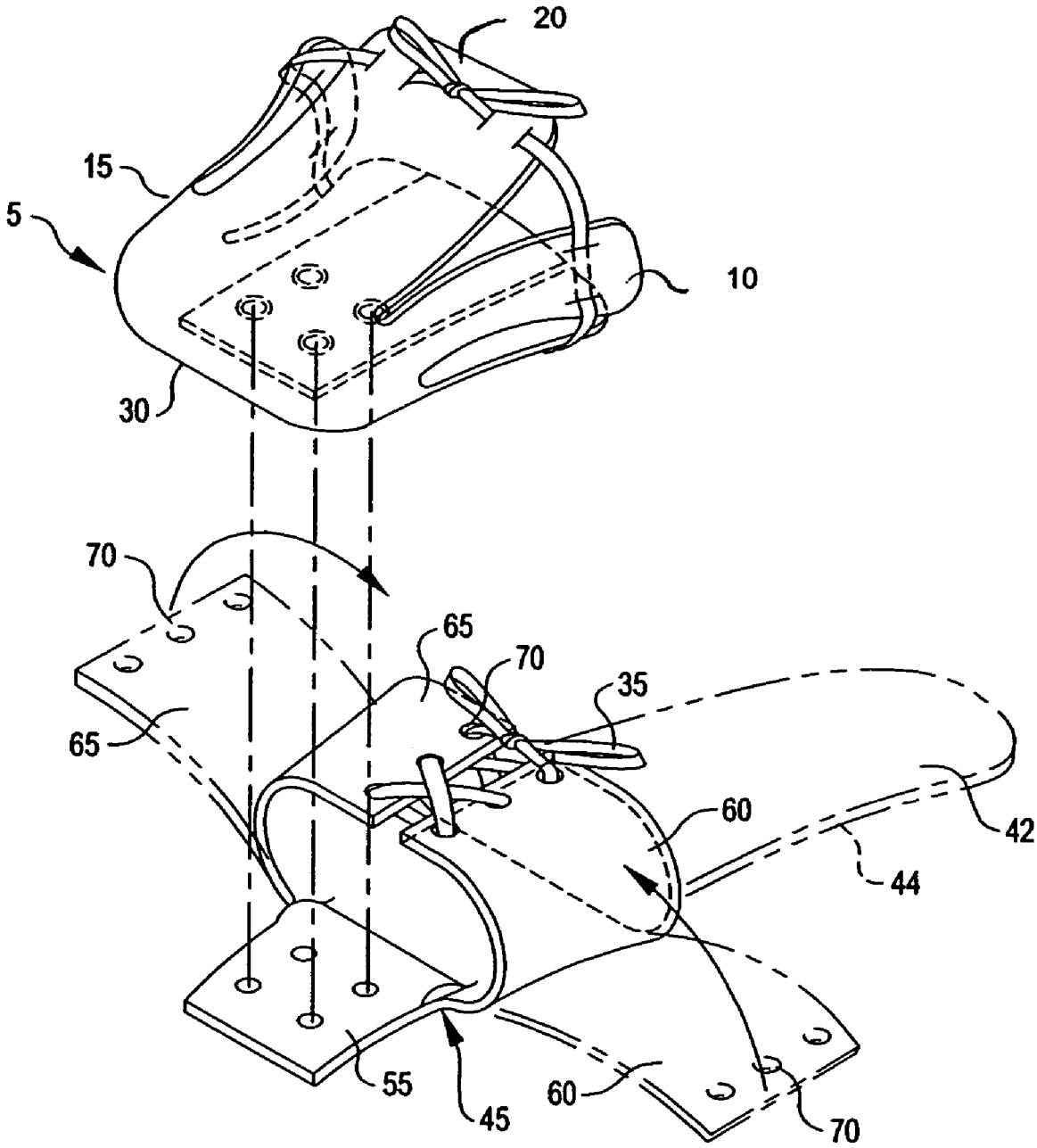
FIG. 1 shows a first exemplary interior perspective view of a first exemplary embodiment of a toe shoe in accordance with the present invention.
Figure 2:
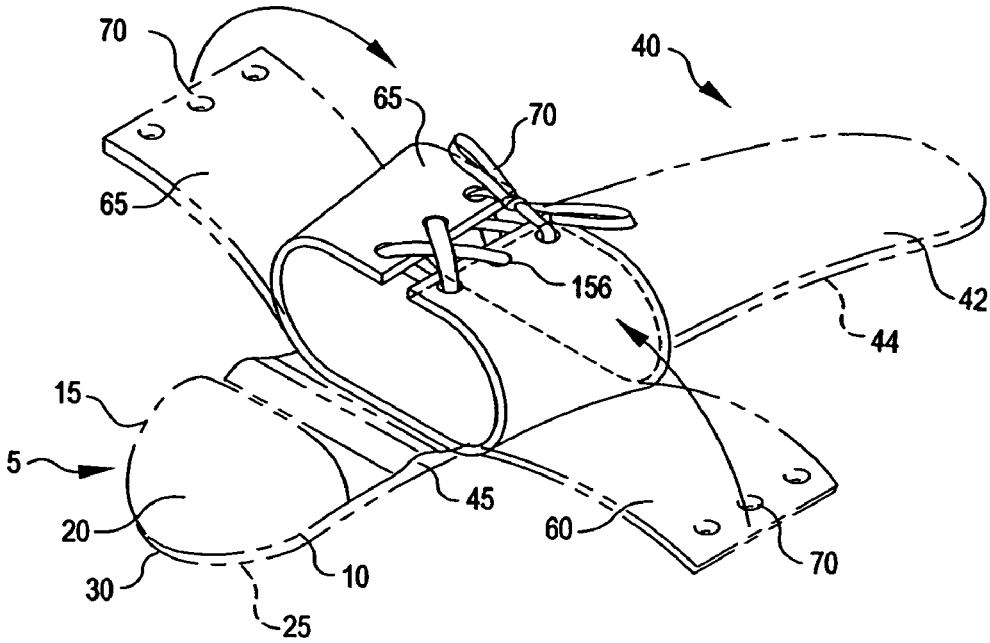
FIG. 2 shows a second exemplary interior perspective view of the first exemplary embodiment of the toe shoe in accordance with the present invention.
Figure 3:
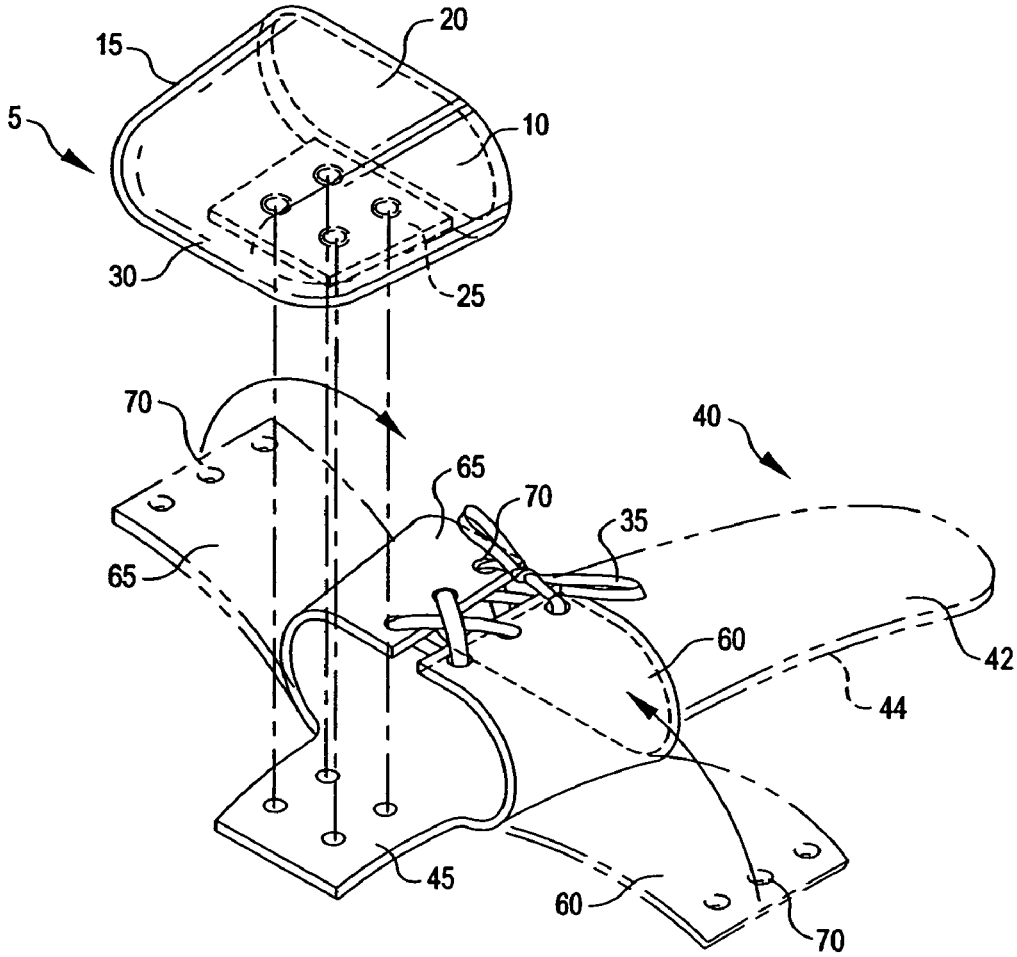
FIG. 3 shows a first exemplary interior perspective view of a second exemplary embodiment of the toe shoe in accordance with the present invention.
Figure 4:
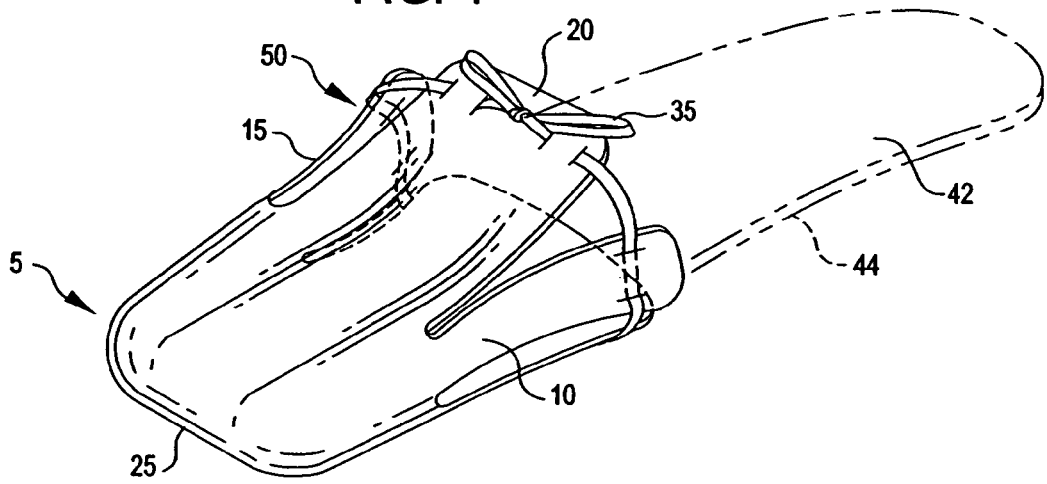
FIG. 4 shows a second exemplary interior perspective view of the second exemplary embodiment of the toe shoe in accordance with the present invention.
Figure 5:
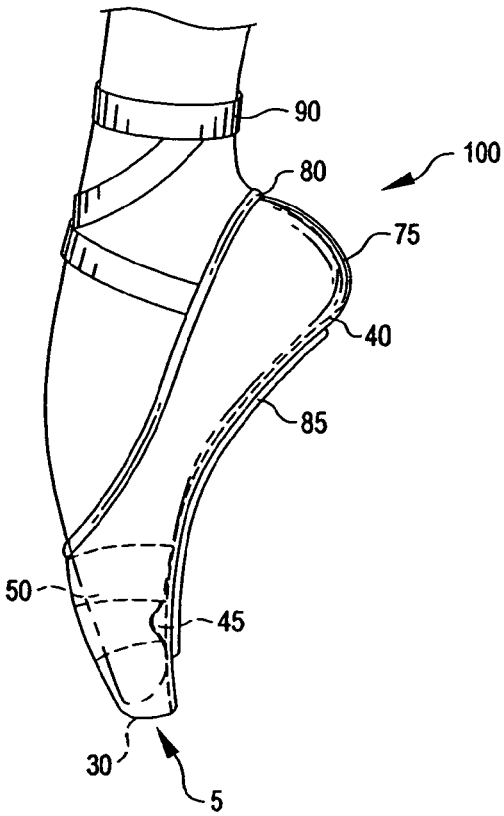
FIG. 5 shows a side perspective view of the first exemplary embodiment of a toe shoe in accordance with the present invention.
Figure 6:
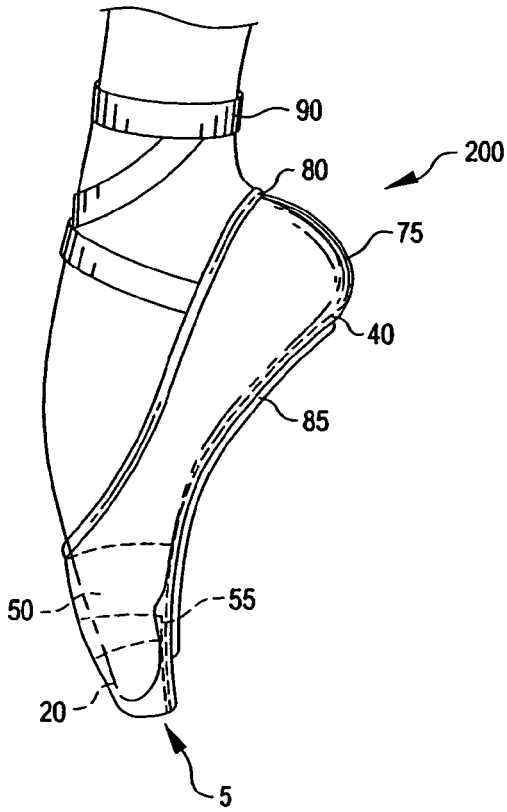
FIG. 6 shows a side perspective view of the second exemplary embodiment of a toe shoe in accordance with the present invention.
Figure 7:
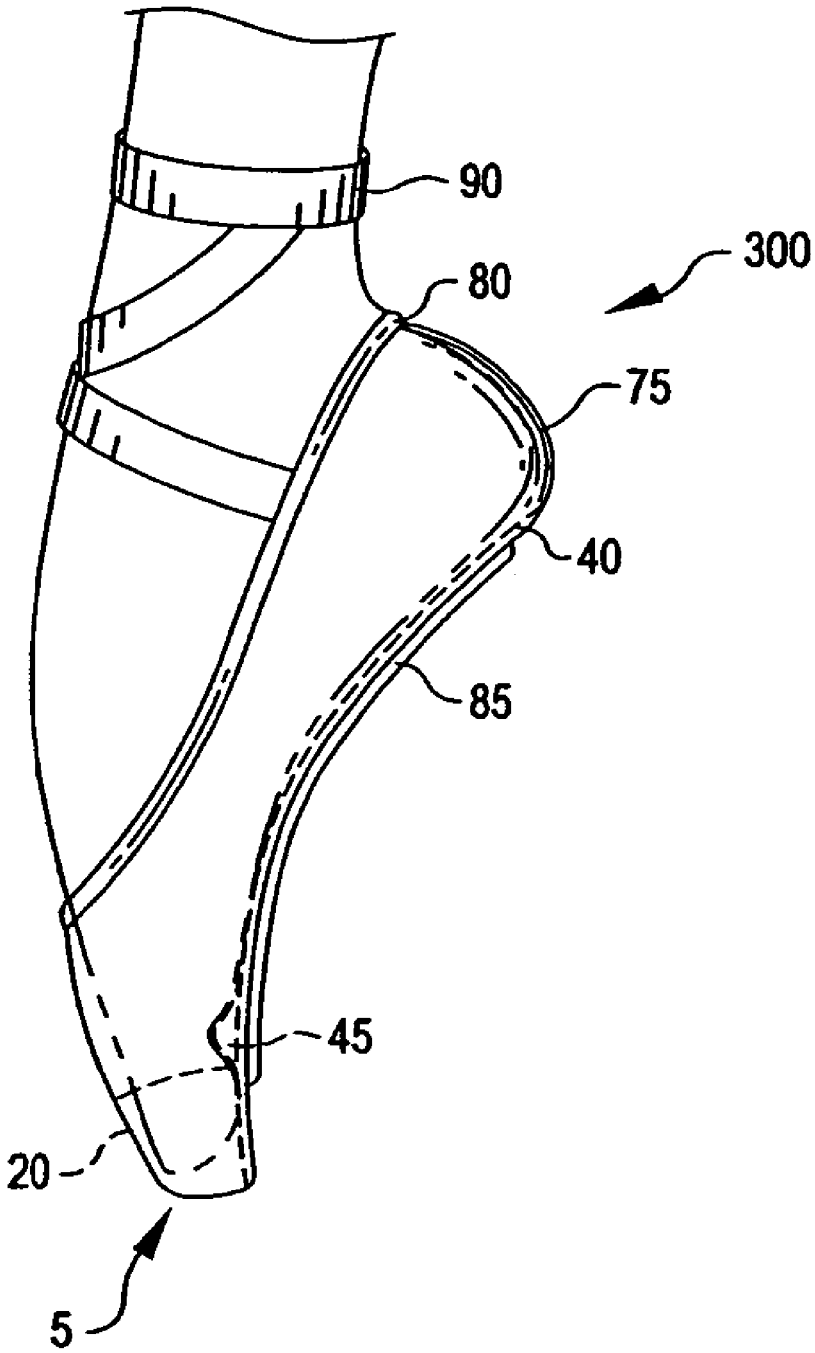
FIG. 7 shows a side perspective view of a third exemplary embodiment of a toe shoe in accordance with the present invention.

The present invention is directed generally to a toe shoe incorporating a support structure. The support structure may include a longitudinal support member, a toe ridge, and/or a foot encirculating tubular member. In the exemplary embodiments described herein, the support structure may be enclosed in a traditional toe shoe upper. FIGS. 1, 2, and 5 show a first exemplary embodiment of the toe shoe 100 of the present invention having a toe box 5, longitudinal support member 40, foot encirculating tubular sleeve 50, and a toe ridge 45. FIGS. 3, 4, and 6 show a second exemplary embodiment of the toe shoe 200 of the present invention having a toe box 5, longitudinal support member 40, and a foot encirculating tubular sleeve 50. FIG. 7 shows a third exemplary embodiment of the toe shoe 300 of the present invention, having a toe box 5, a longitudinal support member 40, and a toe ridge 45.

A. Toe Shoe Elements

1. Toe Box

The toe shoe of the present invention includes a toe box 5, which is shown in FIGS. 2, 3, and 4, as having a left side 10 a right side 15 an upper surface 20 a lower surface 25 and a forward end 30. The forward end 30 of the toe box 5 provides a platform for the ballet dancer to maneuver on while dancing en pointe, and may be curved or flattened.

In an optional embodiment of the toe box 5 of the present invention, the toe box 5 is adjustable ("adjustable toe box"). To create the adjustable toe box 5, which is shown in FIG. 1, the toe box 5 is sectioned such that there is a left side flap 10, upper flap 20, and a right side flap 15.

There are many methods of closing the adjustable toe box 5. In a first preferred method, at least one hole or slit is inserted into the left side flap 10, right side flap 15, and upper flap 20 of the toe box 5. At least one nylon, elastic, steel, kevlar, cotton, rubber, plastic, neoprene, or silk lace (hereinafter "lace") 35, may be intertwined between the at least one hole of the left side flap 10 and the upper flap 20. Similarly, at least one lace 35 may be intertwined between the at least one hole in the right side flap 15 and the upper flap 20. In this preferred method, when the left side flap 10 and upper flap 20 are intertwined by the at least one lace 35, and the right side flap 15 and upper flap 20 are intertwined by the at least one lace 35, an adjustable toe box 5 as shown in FIG. 1 is formed. In a closed position, the adjustable toe box 5 can be any shape as long as there is a suitable structure into which the ballet dancer's foot can be inserted. The at least one lace 35 of the adjustable toe box 5 may be individually tightened to fit the adjustable toe box 5 securely around a ballet dancer's foot. To individually tighten the at least one lace 35 of the adjustable toe box 5, the ballet dancer may fully insert her foot into the toe shoe 100, 200, 300, and tighten the at least one lace 35 around the metatarsal bones of her foot. In an optional preferred embodiment, the ballet dancer rolls down the upper 75, which will be further discussed below, in order to tie the at least one lace 35 around the metatarsal bones of her foot. The dancer then tucks the at least one lace 35 of the adjustable toe box 5 into the upper 75 of the toe shoe 100, 200, 300 and rolls up the upper 75.

The toe box 5 of the toe shoe 100, 200, 300 of the present invention may be assembled using layers of fabric, burlap, cardboard, paper, leather saturated with glue, polymer materials, any combination of these materials, or any other suitable material.

2. Longitudinal Support Member

The toe shoe 100, 200, 300 of the present invention includes a longitudinal support member, shown in FIGS. 1-7 as a shank 40. Preferably, the shank 40 extends rearward from the toe box 5 The shank 40 may be considered a longitudinal support member because it supports the arch of the ballet dancer's foot while the dancer is en pointe. The shank 40 may take any shape commonly known and used in the art. In FIGS. 1, 2, 3, and 4, the shank 40 is shown as having an upper surface 42 and lower surface 44. In a preferred embodiment, the shank 40 is connected to the lower surface 25 of the toe box 5. "Connected" may mean integral, attached directly, attached indirectly, or attachable.

The shank 40 may be manufactured in varying strengths. For example, if a ballet dancer has a flexible or weak foot, the shank 40 may be constructed from stiff materials that support the arch of the dancer's foot. If a ballet dancer has a strong or relatively inflexible foot, the shank 40 may be constructed from more compliant materials so that the dancer's foot may arch without inhibition. Further, the shank 40 may be formed with laminations or an internal opening. A shank 40 formed with laminations or an internal opening may be comprised of varying materials. For example, a first set of laminations may be comprised of layers of fabric, while a second set of laminations may be comprised of cardboard.

The length of the shank 40 may vary based on the type of support desired by the ballet dancer. If full support is desired through the arch of the dancer's foot, the shank 40 may be extended to run the length of the foot, as shown in FIGS. 5 and 6. A half-shank or three-quarter-length shank may also be used.

The shank 40 may be manufactured from commonly known materials including, but not limited to, bamboo, wood, leather, cardboard, steel, plastic, metal, polymer materials, any combination of these materials, or any other suitable materials. In one preferred embodiment, the shank 40 is manufactured from a metal strip such as beryllium copper. In another preferred embodiment, the shank 40 is manufactured from a polymer or plastic strip. The polymer or plastic strip may be polycarbonate, any other type of synthetic thermoplastic resin, any combination of these materials, or any other suitable support materials.

3. Toe Ridge

A toe ridge 45 is included in the first and third exemplary embodiments of the toe shoe 100, 300 of the present invention. The toe ridge 45 is preferably located rearward from the toe box 5. The purpose of the toe ridge 45 is to give the ballet dancer's foot purchase under the knuckles of her toes. The toe ridge 45 provides a grip for the dancer's foot and reduces lateral spreading of the foot and toes in the toe box 5, thereby preventing excessive lateral spreading when the ballet dancer is en pointe. Reducing the lateral spreading of the dancer's foot and toes while en pointe decreases the amount of stress placed on the dancer's foot and toes. Further, by not compressing the foot into the toe box 5 the foot is kept in proper alignment while dancing en pointe and is retained in nearly the same position that the foot would have been in had the ballet dancer been standing flat-footed.

It is preferred that the toe ridge 45 be positioned beneath the underside of the ballet dancer's toes. Specifically, it is preferred that the toe ridge 45 be located beneath the proximal phalanges located in the foot. This position is preferred because when the dancer is dancing en pointe, the toe ridge 45 will provide a purchase that will retain the dancer's foot in the most natural position. The position is also preferred because when the dancer is not en pointe, the toe ridge 45 will be located beneath the proximal phalanges, thereby allowing the dancer to perform without feeling any discomfort to the underside of the dancer's foot.

The toe ridge 45 may be shaped in different ways to provide an optimal fit and comfort to a ballet dancer. The toe ridge 45 may be a solid bar, substantially semi-circular in cross-section. Alternatively, the toe ridge 45 may have a shape more specific to the shape of the dancer's toes. In this alternate embodiment, the toe ridge 45 will have a general structure that would, through use, conform to the exact shape beneath the proximal phalanges of the dancer's foot when the dancer is en pointe. Further, in an adjustable embodiment, the toe ridge 45 may be inflated into a comfortable form. In this adjustable embodiment, the toe ridge 45 is essentially a bladder, whereby a dancer may inflate the toe ridge 45 with support material prior to dancing en pointe until the toe ridge 45 is at an optimal position for the dancer. In another embodiment, the ballet dancer could be provided with a set of toe ridges 45 having different shapes. Based on the type of dance the dancer were performing or the type of stage the dancer were performing on, the dancer could pick the most comfortable toe ridge 45 and attach it between the shank 40 and the outer sole 85, to the shank 40, or between the laminations or through the internal opening of the shank 40, depending on the type of shank contained in the toe shoe 100, 300. Still further, a custom embodiment provides a custom-made toe ridge 45. In this custom embodiment, the area between the ground and the proximal phalanges would be measured for each individual ballet dancer. Based on the measurements, a toe ridge 45 would be created that would conform directly to the area between the ground and the dancer's proximal phalanges.

The toe ridge 45 may be constructed from materials such as leather, cardboard, wood, burlap, fabric, plastic, a combination of these materials, or any other suitable material.

4. Foot Encirculating Tubular Sleeve

A foot encirculating tubular sleeve is included in the first and second exemplary embodiments of the toe shoe 100, 200 of the present invention, and is shown in FIGS. 1-6 as a sling 50. The sling 50 should circumferentially envelop the metatarsal bones of a ballet dancer's foot. The sling 50 diverts the forces acting directly on the dancer's toes, foot, and ankle throughout the ballet dancer's body. Further, in the first embodiment of the toe shoe 100 of the present invention, the sling 50 ensures that the toe ridge 45 remains in useful contact with the underside of a dancer's foot.

There are three preferred embodiments of the sling 50. In the first preferred embodiment of the sling 50, which is shown in FIG. 2, the sling is a closed sling ("closed sling"). In the second preferred embodiment of the sling shown in FIGS. 1 and 3, the sling 50 is integrally connected with a coupler 55 ("coupler sling"). In the third preferred embodiment shown in FIG. 4, the sling 50 is integrally connected with the toe box ("toe box sling").

In order to create the closed sling 50 shown in FIG. 2, a rectangular piece of sling material is attached underneath and lies transverse to the shank 40 such that a first flap 60 and second flap 65 of sling material extend from both sides of the shank 40. The first flap 60 and second flap 65 of sling material may be raised in the direction of the arrows in FIG. 2 and closed, thereby forming a sling 50. In its closed position, the sling 50 should be tubular, which can be almost any shape as long as it is a suitable structure through which a ballet dancer's foot can pass.

There are many methods of closing the sling 50 as shown in FIG. 2. At least one hole 70 may be inserted into both the first flap 60 and the second flap 65 of sling material (the "tying method"). At least one lace 35 may be intertwined between the at least one hole 70 of the first flap 60 and second flap 65 of sling material. If using the tying method for closing the sling 50, it is preferred that when the first flap 60 and second flap 65 of sling material are raised in the direction of the arrows in FIG. 2, at least one lace 35 be tied, thereby forming a sling 50 as shown in FIG. 2. In an optional embodiment of the tying method, the at least one lace 35 of the sling 50 is individually tightened to fit securely around a ballet dancer's foot. To individually tighten the at least one lace 35 of the sling 50, a dancer inserts her foot into the toe shoe and ties the at least one lace 35 around the metatarsal bone of her foot. The dancer then tucks the at least one lace 35 into an upper 75 of the toe shoe 100, while pulling a heel portion of the shoe over the heel of the dancer's foot.

In an alternate method for closing the sling 50 as shown in FIG. 2, the first flap 60 and second flap 65 of sling material may be raised in the direction of the arrows in FIG. 2 and tied with at least one lace 35, hook and loop fastened, glued, nailed, melted, or welded together (the "fastening method"). Any combination of tying with at least one lace 35, hook and loop fastening, gluing, melting, welding, or nailing may be used, along with any other suitable method for securing the first flap 60 and second flap 65 of sling material together to form a sling 50. If the fastening method is used, it is preferred that the fastening of the first flap 60 and second flap 65 of the sling material occur during the manufacturing process of the toe shoe 100, thereby allowing for a variety of sizes and shapes of slings 50 to be formed and inserted into the toe shoe prior to the ballet dancer placing her foot into the toe shoe 100. Further, if the sling is inserted prior to the ballet dancer placing her foot into the toe shoe 100, the materials making up the sling 50 may be of a kind that shrink when heated or damp, so that a ballet dancer wearing the toe shoe 100 during a practice or performance will feel a snugness across the metatarsal bones of her foot due to a shrinking of the sling material. If a shrinkable material is not used, the toe shoe 100 may be incrementally sized in both the length of the dancer's foot and circumferentially transverse the length of the metatarsal area of the dancer's foot. The dancer would specify both a length and a sling size when specifying the toe shoe size.

The second preferred embodiment of the sling is shown in FIGS. 1 and 3, wherein the sling 50 is integrally connected with a coupler 55 ("coupler sling"). In order to create the coupler sling 50 shown in FIGS. 1 and 3, a coupler 55 must extend forward from the coupler sling 50. The coupler 55 is the connective structure between the toe box 5 and the coupler sling 50. As with the coupler sling 50, the coupler 55 may be made of ballistic cloth, leather, cardboard, wood, neoprene, rubber, nylon, silk, metal, burlap, fabric, plastic, any combination of these materials, or any other suitable material. In a preferred embodiment, the coupler 55 and the longitudinal support member 40 are made from the same material.

The toe box 5 may be relieved to fay with the coupler 55. Alternatively, the lower surface 25 of the toe box 5 and the coupler 55 may be connected by gluing, nailing, melting, or welding. Any combination of gluing, melting, welding, or nailing may be used, along with any other suitable method for connecting the lower surface 25 of the toe box 5 with the coupler 55. In another alternative, the coupler 55 may be a longitudinal support member, or a combination of the coupler 55 and the shank 40 may form a longitudinal support member.

In creating the coupler sling 50, a rectangular piece of sling material is transversely connected to the coupler 55, such that a first flap 60 and second flap 65 of sling material extend from both sides of the coupler 55. The first flap 60 and second flap 65 of sling material may be raised in the direction of the arrows in FIG. 3 and closed, thereby forming the coupler sling 50. In a closed position, the coupler sling 50 should be tubular, which can be any shape as long as there is a suitable structure through which the ballet dancer's foot can pass.

As with the closed sling 50 embodiment of the sling 50 of the present invention, the coupler sling 50 may be closed using either the tying method or fastening method, which are discussed above.

The third preferred embodiment of the sling 50 is shown in FIG. 4 as a toe box sling 50. To create the toe box sling 50, a piece of sling material is integrally connected to and extends rearward from the toe box 5. Preferably, the sling material is sectioned such that there is a left side flap 10, upper flap 20, and a right side flap 15.

There are many methods of closing the toe box sling 50. In a first preferred embodiment, at least one hole or slit is inserted into the left side flap 10, right side flap 15, and an upper flap 20. At least one lace 35 may be intertwined between the at least one hole of the left side flap 10 and upper flap 20 of sling material. Similarly, at least one lace 35 may be intertwined between the at least one hole in the right side flap 15 and upper flap 20 of sling material. In this preferred embodiment, when the left side flap 10 and upper flap 20 of sling material are intertwined, and the right side flap 15 and upper flap 20 of sling material are intertwined, a toe box sling 50, as shown in FIG. 4, is formed. In a closed position, the toe box sling 50 should be tubular, which can be any shape as long as there is a suitable structure through which the ballet dancer's foot can be inserted. The at least one lace 35 of the toe box sling 50 may be individually tightened to fit the toe box sling 50 securely around a ballet dancer's foot. To individually tighten the at least one lace of the toe box sling 50, the ballet dancer fully inserts her foot into the toe shoe, and tightens the at least one lace 35 around the metatarsal bones of her foot. In an optional preferred embodiment, the ballet dancer may roll down the upper 75, which will be further discussed below, in order to tie the laces 35 around the metatarsal bones of her foot. The dancer then tucks the laces of the toe box sling 50 into the upper 75 of the toe shoe 200, and rolls up the upper 75.

The sling 50 may be composed of ballistic cloth, leather, cardboard, wood, metal, burlap, fabric, plastic, neoprene, rubber, nylon, silk, any combination of these materials, or any other suitable material (hereinafter "sling material"). In one preferred embodiment, the sling material allows the sling to flex based on movements of the dancer's foot.

5. Upper

The upper 75 of the toe shoe of the present invention is shown in FIGS. 5-7. The upper 75 is aesthetically similar to a traditional toe shoe, covering the toe box 5 and more generally the front of the ballet dancer's foot. The upper 75 may then extend along either side of the ballet dancer's instep and around the ballet dancer's heel. It is preferred that the upper 75 tightly encase both the toe box 5 and shank 40. The upper 75 may further contain a cotton, elastic, or silk drawstring cuff 80 around the edge of the shoe to allow for individual fitting of the toe shoe 100, 200, 300 to the ballet dancer's foot.

The upper 75, which is commonly known in the art, may be composed of materials commonly used in the art, including, but not limited to, fabrics such as silk, canvas, rayon, satin, any combination of these materials, or any other suitable materials.

6. Outer Sole

The toe shoe of the present invention further contains an outer sole 85, which is shown in FIGS. 5-7. The outer sole 85 provides a non-slip surface for the ballet dancer's foot when it comes into contact with the floor. Further, the outer sole 85 allows a dancer to grip and feel the floor while practicing or performing. The outer sole 85 may be attached to the bottom of the upper 75 using any method commonly known in the art, including but not limited to gluing or sewing. While the outer sole 85 may be as thick as desired, in a preferred embodiment the outer sole 85 is thin enough to allow a ballet dancer to feel the dance floor when dancing. The outer sole 85 may be formed with laminations or an internal opening. An outer sole 85 formed with laminations or an internal opening may be comprised of varying materials. For example, the first set of laminations may be comprised of fabric, while the second set of laminations may be comprised of cardboard. Finally, the outer sole 85 may be the same size as the toe shoe 100, 200, 300, or narrower and shorter than the dancer's foot. Further, the outer sole 85 may be in two pieces, thereby freeing the arch of the foot and allowing for plantar flexion while a ballet dancer is en pointe.

The outer sole 85 of the toe shoe 100, 200, 300 of the present invention may be composed of any material capable of flexing, including suede, buffed leather, scored leather, plastic, fabric, any combination of these materials, or any other suitable materials.

7. Ribbon

If desired, at least one ribbon, lace, or elastic strip (hereinafter "ribbon") 90 may be attached to the toe shoe 100, 200, 300 of the present invention in any method commonly known by persons having skill in the art. The at least one ribbon 90 may be wound, tied, or secured by the ballet dancer around the dancer's legs and/or ankles, providing both additional support to the dancer's foot and aesthetic similarity to the traditional toe shoe.

The at least one ribbon 90 may be composed of silk, silk with elastic, elastic, any combination of these materials, any material commonly known and used by others having skill in the art, or any other suitable materials.

B. Exemplary Embodiments

FIG. 5 shows the first exemplary embodiment of the toe shoe 100 of the present invention. The toe shoe 100 has a toe box 5, longitudinal support member 40, toe ridge 45, foot encirculating tubular sleeve 50, upper 75, outer sole 85, and optional ribbon 90. Extending rearward from the toe box 5 is a longitudinal support member shown as a shank 40.

A toe ridge 45 is preferably located rearward from the toe box 5. As stated above, it is preferred that the toe ridge 45 be positioned beneath the underside of the ballet dancer's toes. Specifically, it is preferred that the toe ridge 45 be located beneath the proximal phalanges located in the foot.

It is further preferred that the toe ridge 45 be attached to the toe shoe 100 between the shank 40 and the outer sole 85. In a first preferred embodiment, the toe ridge 45 is joined with a shank 40 having laminations or an internal opening. "Joined" may mean integral, permanently incorporated, adjustable, replaceable, or movable. In a second preferred embodiment, the optional toe ridge 45 is permanently incorporated as part of the shank 40. In a third preferred embodiment, the optional toe ridge 45 is adjustable. An adjustable toe ridge 45 allows for the placement of the toe ridge 45 in any desired position along the shank 40. Further, an adjustable toe ridge 45 allows the toe ridge 45 to be suitably fitted to a ballet dancer's foot based on the length and shape of the foot. In a fourth preferred embodiment, the optional toe ridge 45 is replaceable. When the toe ridge 45 becomes worn down, or if the toe ridge is too large or too small for a ballet dancer, the replaceable toe ridge 45 may be removed from the toe shoe 100 and replaced with a desired toe ridge 45. In a fifth preferred embodiment, a movable, clamp or spring-type attachment may be located below the optional toe ridge 45, thereby allowing the toe ridge 45 to move up and down the shank 40 based on the position of the ballet dancer's foot within the toe shoe 100.

Located rearward of the toe ridge 45 is a foot encirculating tubular sleeve, which is shown in FIG. 5 as a sling 50. There are a number of preferred embodiments for attaching the sling 50 to the shank 40. "Attached," as used for purposes of the first exemplary embodiment of the toe shoe 100 of the present invention, may mean permanently incorporated, adjustable, tie-able, or replaceable. In a first preferred embodiment, the sling 50 is permanently incorporated into the shank 40. In a second preferred embodiment, the sling 50 is adjustable. The adjustable embodiment allows for the sling 50 to be placed in any desired position along the shank 40. The adjustable embodiment further allows the sling 50 to be suitably fitted to a ballet dancer's foot based on the varying lengths and shapes of her foot. In a third preferred embodiment, the sling 50 may be tied to the outer sole 85 or shank 40. At least one lace is passed through at least one hole located in the sling 50 and through at least one hole located in either the shank 40 or outer sole 85 of the toe shoe 100. The sling 50 may fit above or below the shank 40 or outer sole 85. In a fourth preferred embodiment, the shank 40 or outer sole 85 has been formed with laminations or an internal opening, and the sling 50 passes through the internal opening or between the at least two layers of the shank 40 or outer sole 85. In a fifth preferred embodiment, the sling 50 is replaceable. If the sling 50 becomes worn down, or if the sling 50 is too large or too small for the ballet dancer's foot, the sling 50 may be removed from the toe shoe 100 and replaced with a new or properly, fitting sling 50.

Preferably, the toe box 5, shank 40, toe ridge 45, and sling 50 are enclosed by an upper 75. Preferably attached to the bottom of the upper 75 is an outer sole 85. If desired, at least one ribbon, lace, or elastic strip (hereinafter "ribbon") 90 may be attached to the first exemplary embodiment of the toe shoe 100 of the present invention in any method commonly known by persons having skill in the art.

Referring now to FIGS. 3 and 6, a second exemplary embodiment of the toe shoe 200 of the present invention is shown. The toe shoe 200 has a toe box 5. Located rearward of the toe box 5 is a support structure in the form of a foot encirculating tubular sleeve, which is shown in FIGS. 3 and 6 as a sling 50.

A longitudinal support member, which is shown in FIGS. 3 and 6 as a shank 40, extends rearward from the forward end 30 of the toe box 5 and may be located over the lower surface 25 of the toe box 5, and the sling 50. Preferably, the shank 40 has an upper surface 42 and lower surface 44. In one preferred embodiment, the lower surface 25 of the toe box 5 is connected to the upper surface 42 of the shank 40. "Connected" may mean integral, attached directly, attached indirectly, or attachable. The lower surface 25 of the toe box 5, and the sling 50 may be connected to the shank 40 using methods and materials commonly known in the art such as using small nails, sewing, or gluing. In another preferred embodiment, especially where the coupler sling 50 is used, the longitudinal support member is a combination of the shank 40 and the coupler 55.

In a preferred embodiment, the shank 40, toe box 5, and sling 50 are surrounded by an upper 75. As with the first embodiment, it is preferred that an outer sole 85 be attached to the bottom of the upper 75. If desired, at least one ribbon 90 may be attached to the toe shoe 200 in the methods such as those discussed for the at least one ribbon 90 of the first exemplary embodiment of the toe shoe 100 of the present invention.

FIG. 7 shows the third exemplary embodiment of the toe shoe 300 of the present invention. The toe shoe 300 has a toe box 5 such as the toe box 5 discussed in the first exemplary embodiment of the toe shoe 100 of the present invention.

Preferably extending rearward from the toe box 5 is a longitudinal support member shown in FIG. 7 as a shank 40. The shank 40 of the third exemplary embodiment may be manufactured and connected to the toe box 5 using the methods such as those discussed in the first exemplary embodiment of the toe shoe 100 of the present invention.

A toe ridge 45 is located rearward from the toe box 5. The toe ridge 45 of the third exemplary embodiment may be attached, constructed, shaped, and located using the methods such as those discussed for the toe ridge 45 in the first exemplary embodiment of the toe shoe 100 of the present invention.

In a preferred embodiment, the shank 40, toe box 5, and toe ridge 45 are surrounded by an upper 75. As with the first and second exemplary embodiments of the toe shoes 100, 200 of the present invention, it is preferred that attached to the bottom of the upper 75 is an outer sole 85. As with the first and second exemplary embodiments of the toe shoes 100, 200 of the present invention, at least one ribbon 90 may be attached to the toe shoe 300 in the methods such as those discussed for the at least one ribbon 90 of the first and second exemplary embodiments of the toe shoes 100, 200 of the present invention.

C. Miscellaneous

Although the description and drawings generally describe a toe shoe worn by a female, it is to be understood that the present invention describes a toe shoe that can be worn by either male, female, child, or adult. The terms "her," "she," "ballet dancer," and "female" as used in the description of the invention are for descriptive purposes only and are not intended to limit the scope of the invention.

It is to be further understood that the description and drawings generally describe a toe shoe that can be fitted to either the left or right foot, and the present invention encompasses a toe shoe, whether made as a pair for a left and right foot or as individual toe shoes made for use on either foot.

The terms and expressions used in the foregoing specification are used as terms of description and not of limitation, and are not intended to exclude equivalents of the features shown and described or portions of them. The scope of the invention is defined and limited only by the claims that follow.

What is claimed is:

1. Support structure for providing support to a dancer's foot while dancing en pointe, said support structure for use with a toe shoe having a toe end and a heel end, said toe end having a toe box incorporated therein, said support structure comprising:

(a) a longitudinal support member;

(b) said longitudinal support member extending at least partially between said toe end and said heel end;

(c) a toe ridge;

(d) said toe ridge attached to said longitudinal support member between said toe end and said heel end;

(e) a foot-encirculating tubular sleeve connectable to said longitudinal support member;

(f) said toe ridge being positioned along said longitudinal support member so that, while dancing en pointe, said dancer's foot is given purchase; and (g) said foot-encirculating tubular sleeve being positioned along said longitudinal support member so that during en pointe dancing, said dancer's foot is at least partially supported by said foot-encirculating tubular sleeve and said longitudinal support member.

* * * * *